US007063507B2

(12) United States Patent
Hsieh

(10) Patent No.: US 7,063,507 B2
(45) Date of Patent: Jun. 20, 2006

(54) BALANCE ADJUSTED FAN

(76) Inventor: Hsin-mao Hsieh, No. 6, East Section Industrial 6th Rd., Pingtung City, Pingtung (TW)

( * ) Notice: Subject to any disclaimer, the term of this patent is extended or adjusted under 35 U.S.C. 154(b) by 93 days.

(21) Appl. No.: 10/838,349

(22) Filed: May 5, 2004

(65) Prior Publication Data

US 2005/0249596 A1 Nov. 10, 2005

(51) Int. Cl.
*F04D 29/66* (2006.01)

(52) U.S. Cl. ..... 416/144; 415/119

(58) Field of Classification Search ..... 416/144, 416/145, 62

See application file for complete search history.

(56) References Cited

U.S. PATENT DOCUMENTS 6,302,650 B1 * 10/2001 Williams et al. ..... 416/144

* cited by examiner

*Primary Examiner*—Edward K. Look
*Assistant Examiner*—Richard A. Edgar
(74) *Attorney, Agent, or Firm*—Troxell Law Office, PLLC

(57) ABSTRACT

A balance adjusted fan mainly includes a hub, a shaft and a plurality of blades. The hub has a ring-wall and a top wall, and the shaft is connected to the top wall. The ring-wall has a plurality of socket holes that can be formed on the top edge, the bottom edge or the outside surface of the ring-wall. The blades are formed on the outside surface of the ring-wall. When the fan rotates in unbalance, at least a balance weight can be connected in one of the socket hole in an appropriate position that opposes to the heavier side of the hub to stabilize the rotation balance of the fan.

15 Claims, 3 Drawing Sheets

BALANCE ADJUSTED FAN

FIELD OF THE INVENTION

The present invention relates to a fan, particularly to a balance adjusted fan.

BACKGROUND OF THE INVENTION

A fan generally utilizes rotating blades to generate airflow so as to dissipate the heat from electronic devices. When the fan rotates, the balance of rotating fan is basically required. A conventional fan, which is disclosed in U.S. Pat. No. 6,648,602 entitled "fan having balancing blade sets", comprises a central hub, a shaft and at least three blade sets. The shaft is formed through and axially extends from the central hub. The blade sets are formed radially and outward extending from a ring-wall of the central hub in stagger arrangement, and properly have different included angles for stable rotation of the fan. However, the three blade sets must have equivalent total mass (weight) to enable the three blade sets to be balanced in regard to the shaft during rotating. The fan will shake and unbalance to affect the airflow while the fan rotates if there is no equivalent total mass among the three blade sets. The conventional fan without equivalent total mass of the three blade sets cannot be reworked and has to be abandoned because that the three blade sets are formed together by plastic injection.

SUMMARY

The main object of the present invention is to provide a balance adjusted fan, which has a plurality of socket holes formed on a ring-wall of a hub, wherein the socket holes can be formed on a top edge, a bottom edge or an outside surface of the ring-wall. When the fan rotates in unbalance, at least a balance weight is connected in one of the socket holes in an appropriate position that opposes to the heavier side of the hub to stabilize the rotation balance of the fan.

The balance adjusted fan of the present invention mainly comprises a hub, a shaft and a plurality of blades. The hub has a ring-wall and a top wall, the shaft is connected to the top wall. The ring-wall has a top edge, a bottom edge, an outside surface and an inside surface. A plurality of socket holes are formed on the ring-wall, wherein the socket holes can be formed on the top edge, bottom edge or outside surface of the ring-wall. The blades are formed on the outside surface of the ring-wall. When the fan rotates in unbalance, at least a balance weight is connected in one of the socket holes in an appropriate position that opposes to the heavier side of the hub to stabilize the rotation balance when the fan rotates.

DETAILED DESCRIPTION OF THE PRESENT INVENTION

Figure 1:
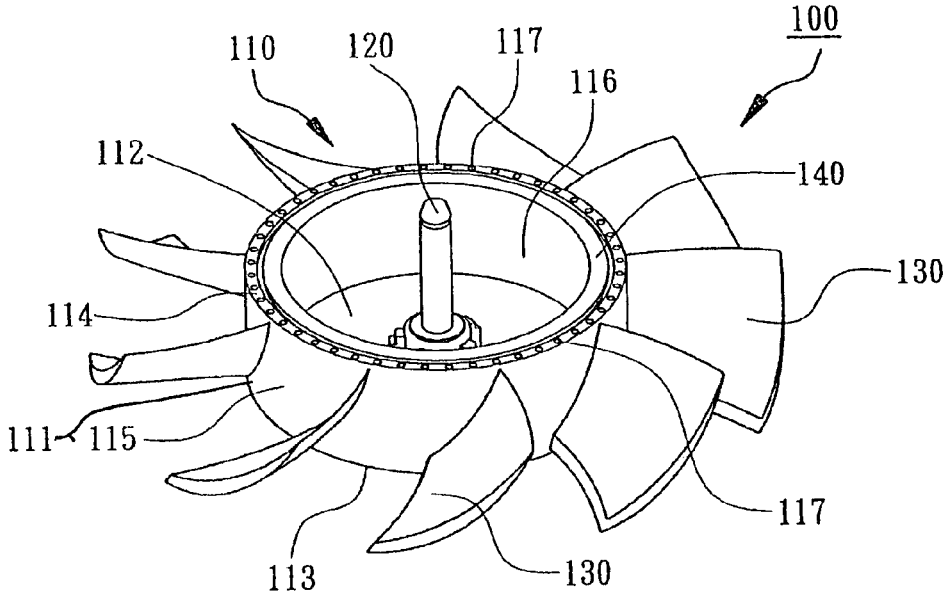
FIG. 1 is a perspective view of a balance adjusted fan in accordance with a first embodiment of the present invention.

Referring to the drawings attached, the present invention will be described by means of the embodiments below.

Figure 2:
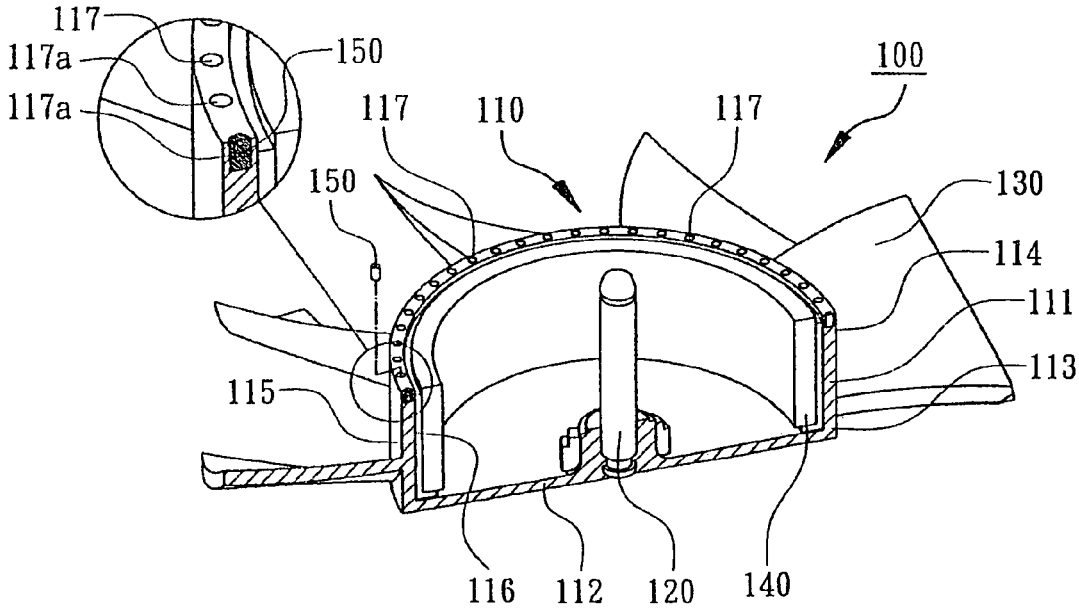
FIG. 2 is a partial cutaway view of a balance adjusted fan in accordance with the first embodiment of the present invention.

According to the first embodiment of the present invention, referring to FIG. 1 and FIG. 2, a balance adjusted fan 100 generally comprises a hub 110, a shaft 120 and a plurality of blades 130. The hub 110 is uniformly formed and has a ring-wall 111 and atop wall 112. The shaft 120 is made by metal and connected to the top wall 112 of the hub 110. The ring-wall 111 has a top edge 113, a bottom edge 114, an outside surface 115 and an inside surface 116, moreover a plurality of socket holes 117 are formed on the ring-wall 111. In this embodiment, the socket holes 117 are formed on the bottom edge 114 of the ring-wall 111. The blades 130 are uniformly and integratedly connected with the hub 110 through plastic injection to form on the outside surface 115 of the ring-wall 111. Preferably, one end of the shaft 120 can be directly covered and fixed to the top wall 112 of the hub 110. A rubber magnet 140 can be connected to the inside surface 116. The fan 100 will rotate in unbalance while the blades 130 do not have equivalent total mass or the total mass distribution of the fan 100 is unbalanced due to the rubber magnet 140. Referring to FIG. 2, at least a balance weight 150 is connected in one 117*a* of the socket holes 117 in an appropriate position that opposes to the relatively heavier side of the fan 100 to stabilize the rotating balance while the fan 100 rotates. The connection of the balance weight 150 to the socket holes 117*a* can use plug-in or screwing method. Besides, it is better to completely hide the balance weight 150 inside the socket hole 117*a* without protruding the bottom edge 114 of the ring-wall 111 so as to avoid causing noise of wind shear to affect rotation of the fan 100.

Figure 3:
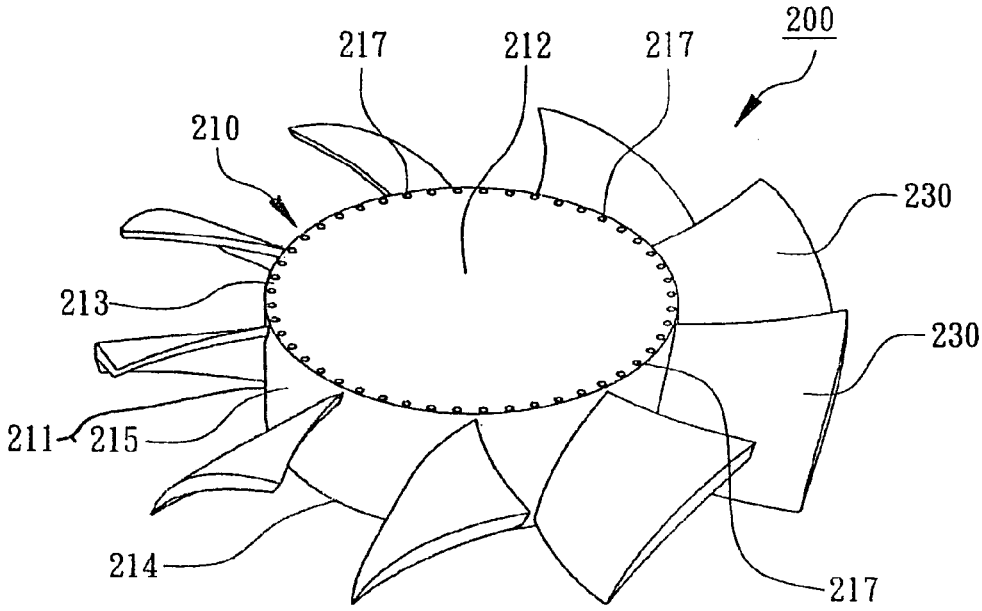
FIG. 3 is a perspective view of a balance adjusted fan in accordance with a second embodiment of the present invention.
Figure 4:
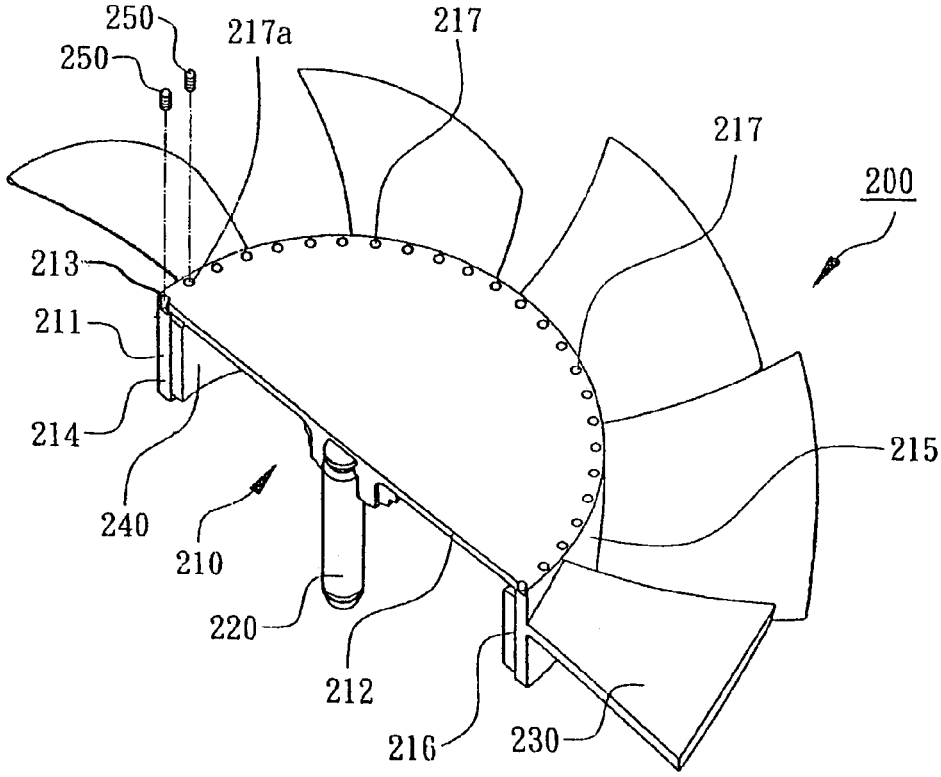
FIG. 4 is a partial cutaway view of a balance adjusted fan in accordance with the second embodiment of the present invention.

According to the second embodiment of the present invention, referring to FIG. 3 and FIG. 4, a balance adjusted fan 200 comprises a hub 210 having a ring-wall 211 and a top wall 212. The top wall 212 is connected with a shaft 220. The ring-wall 211 has a top edge 213, a bottom edge 214, an outside surface 215 and an inside surface 216, moreover a plurality of socket holes 217 are formed on the ring-wall 211. In this embodiment, the socket holes 217 are formed on the top edge 213 of the ring-wall 211, and a plurality of blades 230 are formed on the outside surface 215 of the ring-wall 211. The blades 230 are uniformly and integratedly connected with the hub 210 through plastic injection, also one end of the shaft 220 is directly covered and fixed to the top wall 212 of the hub 210. The inside surface 216 can be connected with a rubber magnet 240. When the fan 200 rotates in unbalance, at least one balance weight 250 having a thread is connected in one 217*a* of the socket holes 217 (as shown in FIG. 4) in an appropriate position that opposes to the heavier side of the hub 210 to stabilize the rotation balance while the fan 200 rotates. The socket holes 217 can have corresponding threads for selectively connecting the balance weight 250 by screwing method. Preferably, the balance weight 250 is completely hidden inside the socket hole 217*a* without protruding the top edge 213 of the ring-wall 211 so as to avoid causing noise of wind shear to affect rotation of the fan 200.

Figure 5:
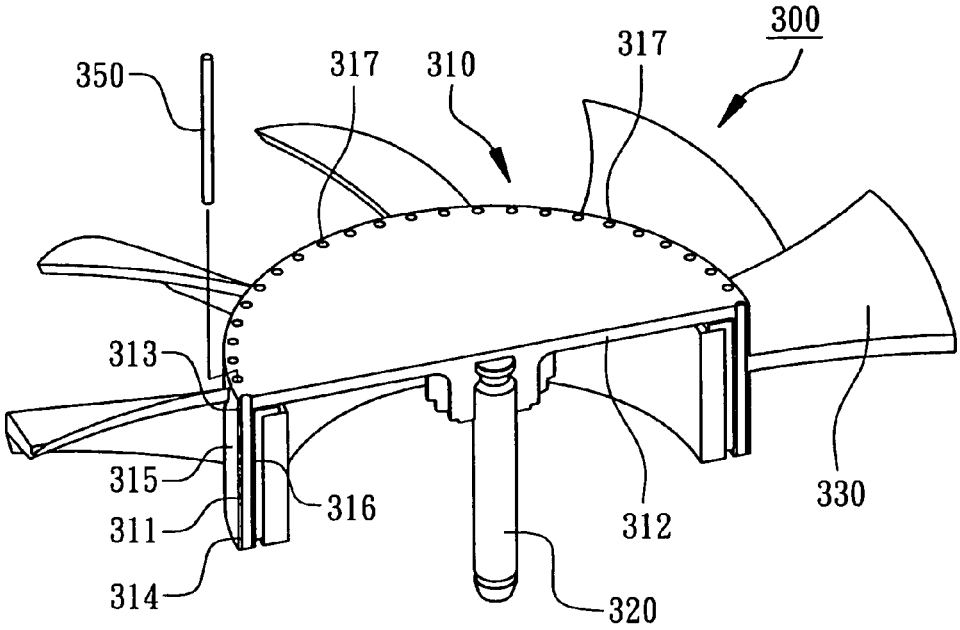
FIG. 5 is a perspective view of a balance adjusted fan in accordance with a third embodiment of the present invention.

According to the third embodiment of the present invention, referring to FIG. 5, a balance adjusted fan 300, which is mostly same as that of the first embodiment in structure, comprises a hub 310 having a ring-wall 311 and a top wall 312, a shaft 320 and a plurality of blades 330. The shaft 320 is connected to the top wall 312. The ring-wall 311 has a top edge 313, a bottom edge 314, an outside surface 315 and an inside surface 316, moreover a plurality of socket holes 317 are formed on the ring-wall 311. In this embodiment, the socket holes 317 pass through the top edge 313 and the bottom edge 314 of the ring-wall 311. When the fan 300 rotates in unbalance, at least a balance weight 350 is connected in one of the socket holes 317 in an appropriate location that opposes to the heavier side of the hub 310 to stabilize the rotation balance while the fan 300 rotates. Besides, it is better that the balance weight 350 is completely hidden inside the socket hole 317 without protruding the top edge 313 or the bottom edge 314.

Figure 6:
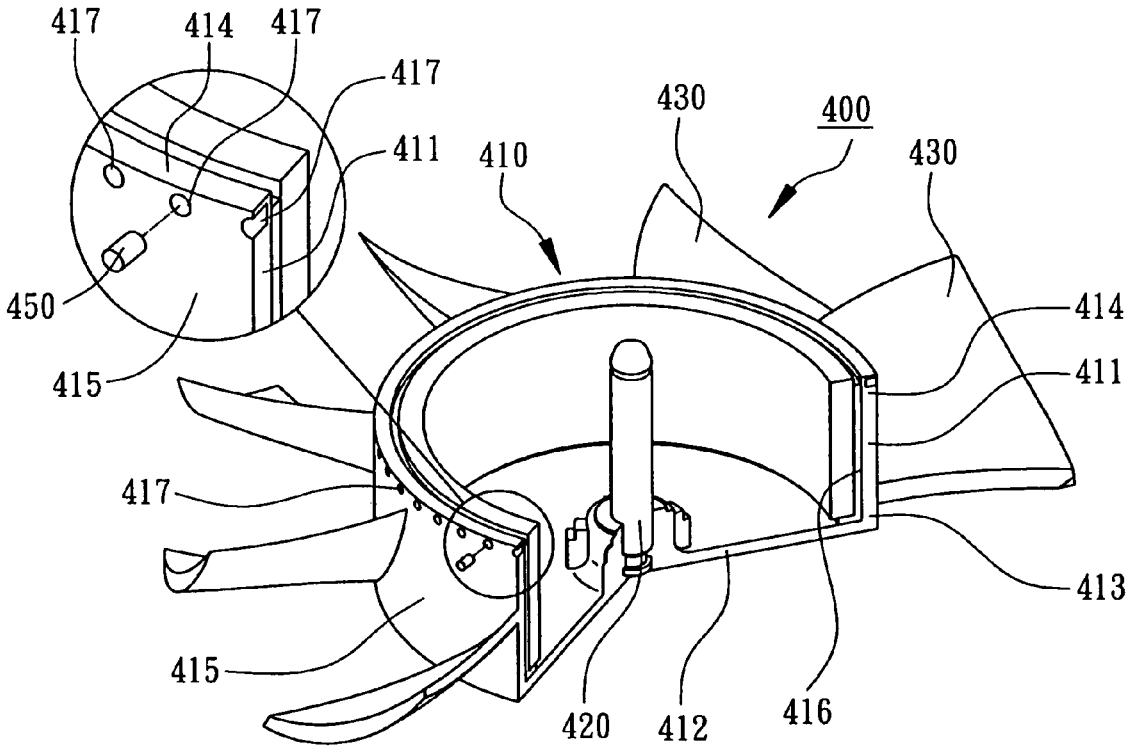
FIG. 6 is a perspective view of a balance adjusted fan in accordance with a fourth embodiment of the present invention.

Referring to FIG. 6, a balance adjusted fan 400 in accordance with the fourth embodiment of the present invention, which is generally same as that of the first embodiment in structure, comprises a hub 410, a shaft 420 and a plurality of blades 430. The hub 410 has a ring-wall 411 and a top wall 412. The shaft 420 is connected to the top wall 412. The ring-wall 411 has a top edge 413, a bottom edge 414, an outside surface 415 and an inside surface 416, moreover a plurality of socket holes 417 are formed on the ring-wall 411. In this embodiment, the socket holes 417 are symmetrically disposed on the outside surface 415 of the ring-wall 411. The socket hole 417 can pass through the outside surface 415 and the inside surface 416. When the fan 400 rotates in unbalance, a balance weight 450 is connected in one of the socket hole 417 corresponding to unbalanced part to balance the entire mass of the fan 400 for stable rotation of the fan 400. Preferably, the balance weight 450 is placed inside the socket hole 417 without protruding beyond the top edge 415.

Therefore, the present invention is to form a plurality of socket holes symmetrically disposed at the appropriate position of the top edge, the bottom edge or outside surface of the ring-wall of the hub. When the fan rotates in unbalance, at least a balance weight is connected in one of the socket holes that opposes to the heavier side of the hub in order to achieve a stable rotation while the fan rotates.

The above description of embodiments of this invention is intended to be illustrated and not limited. Other embodiments of this invention will be obvious to those skilled in the art in view of the above disclosure.

What is claimed is:

1. A fan comprising:

a hub having a ring-wall and a top wall, the ring-wall having a top edge, a bottom edge, an outside surface and an inside surface, a plurality of socket holes are formed on the outside surface of the ring-wall for selectively connecting a balance weight;

a shaft connected to the top wall; and a plurality of blades formed on the outside surface of the ring-wall.

2. The fan in accordance with claim 1, wherein the socket holes are symmetric.

3. The fan in accordance with claim 1, wherein the socket holes have threads.

4. The fan in accordance with claim 1, further comprising at least one of the balance weight connected in one of the socket holes to stabilize the rotation balance of the fan.

5. The fan in accordance with claim 4, wherein the balance weight is completely hidden inside the corresponding socket hole without protruding the outside surface.

6. A fan comprising:

a hub having a ring-wall and a top wall, the ring-wall having a top edge, a bottom edge, an outside surface and an inside surface, a plurality of socket holes are formed on the ring-wall for selectively connecting a balance weight, wherein the socket holes pass through the outside surface and the inside surface of the ring-wall;

a shaft connected to the top wall; and a plurality of blades formed on the outside surface of the ring-wall.

7. The fan in accordance with claim 6, wherein the socket holes are symmetric.

8. The fan in accordance with claim 6, wherein the socket holes have threads.

9. The fan in accordance with claim 6, further comprising at least one of the balance weight connected in one of the socket holes to stabilize the rotation balance of the fan.

10. The fan in accordance with claim 9, wherein the balance weight is completely hidden inside the corresponding socket hole without protruding the outside surface and the inside surface.

11. A fan comprising:

a hub having a ring-wall and a top wall, the ring-wall having a top edge, a bottom edge, an outside surface and an inside surface, a plurality of socket holes are formed on the ring-wall for selectively connecting a balance weight, wherein the socket holes pass through the top edge and the bottom edge of the ring-wall;

a shaft connected to the top wall; and a plurality of blades formed on the outside surface of the ring-wall.

12. The fan in accordance with claim 11, wherein the socket holes are symmetric.

13. The fan in accordance with claim 11, wherein the socket holes have threads.

14. The fan in accordance with claim 11, further comprising at least one of the balance weight connected in one of the socket holes to stabilize the rotation balance of the fan.

15. The fan in accordance with claim 14, wherein the balance weight is completely hidden inside the corresponding socket hole without protruding the top edge and the bottom edge.

* * * * *